US009643423B2

(12) United States Patent
Kimura et al.

(10) Patent No.: US 9,643,423 B2
(45) Date of Patent: May 9, 2017

(54) LIQUID CONTAINER WITH OPTICALLY TRANSPARENT AREA AND LIQUID EJECTION APPARATUS INCLUDING LIQUID CONTAINER WITH VISUAL RECOGNITION PORTION

(71) Applicant: SEIKO EPSON CORPORATION, Tokyo (JP)

(72) Inventors: Naomi Kimura, Nagano (JP); Shoma Kudo, Nagano (JP); Munehide Kanaya, Nagano (JP); Hidenao Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/762,923

(22) PCT Filed: Jan. 15, 2014

(86) PCT No.: PCT/JP2014/000151
§ 371 (c)(1),
(2) Date: Jul. 23, 2015

(87) PCT Pub. No.: WO2014/115506
PCT Pub. Date: Jul. 31, 2014

(65) Prior Publication Data

US 2015/0367648 A1 Dec. 24, 2015

(30) Foreign Application Priority Data

Jan. 24, 2013 (JP) ..... 2013-010925

(51) Int. Cl.
*B41J 2/175* (2006.01)
*B41J 29/02* (2006.01)
*B41J 29/13* (2006.01)

(52) U.S. Cl.
CPC ..... *B41J 2/17553* (2013.01); *B41J 2/175* (2013.01); *B41J 2/17509* (2013.01);
(Continued)

(58) Field of Classification Search
CPC B41J 2/17513; B41J 2/17503; B41J 2/17506; B41J 2/1752; B41J 2/17523; B41J 2/17553
See application file for complete search history.

(56) References Cited

U.S. PATENT DOCUMENTS 4,698,650 A 10/1987 Watanabe et al.
6,585,358 B2 * 7/2003 Usui ..... B41J 2/17513 347/85

(Continued)

FOREIGN PATENT DOCUMENTS

CN 1184076 C 1/2005
JP 60-206688 A 10/1985

(Continued)

*Primary Examiner* — Juanita D Jackson
(74) *Attorney, Agent, or Firm* — Global IP Counselors, LLP

(57) ABSTRACT

There is provided a liquid container including a casing that has a side wall surrounding a container portion configured to contain a liquid; a projecting portion that is provided inside of the container portion to be protruded from a fourth wall corresponding to a bottom of the container portion; and a supply port that is provided in the casing to communicate with outside of the casing through an outer area outside of an overlapping area which overlaps the projecting portion in the container portion in a planar view of the fourth wall and discharge the liquid from the container portion. At least part of a second wall provided to face the projecting portion across a first liquid reservoir has optical transparency.

26 Claims, 13 Drawing Sheets

(52) U.S. Cl.
CPC ..... *B41J 2/17523* (2013.01); *B41J 29/02* (2013.01); *B41J 29/13* (2013.01)

(56) References Cited

U.S. PATENT DOCUMENTS

| | | | |
|---|---|---|---|
| 2001/0020971 | A1 | 9/2001 | Usui et al. |
| 2003/0128261 | A1 | 7/2003 | Usui et al. |
| 2005/0057626 | A1 | 3/2005 | Usui et al. |
| 2006/0082622 | A1 | 4/2006 | Yonekawa et al. |
| 2006/0187280 | A1 | 8/2006 | Yan |
| 2007/0109369 | A1 | 5/2007 | Usui et al. |
| 2009/0033726 | A1 | 2/2009 | Iijima |
| 2009/0167827 | A1 | 7/2009 | Usui et al. |
| 2012/0062663 | A1 | 3/2012 | Usui et al. |
| 2014/0009542 | A1 | 1/2014 | Usui et al. |
| 2014/0368586 | A1 | 12/2014 | Usui et al. |
| 2016/0067976 | A1 | 3/2016 | Usui et al. |

FOREIGN PATENT DOCUMENTS

| | | | |
|---|---|---|---|
| JP | 63-137707 | U | 9/1988 |
| JP | 06-106730 | A | 4/1994 |
| JP | 08-281966 | A | 10/1996 |
| JP | 10-086407 | A | 4/1998 |
| JP | 2003-205624 | A | 7/2003 |
| JP | 2009-034836 | A | 2/2009 |
| JP | 2011-161932 | A | 8/2011 |
| JP | 2013-000949 | A | 1/2013 |

* cited by examiner

Prior Art

LIQUID CONTAINER WITH OPTICALLY TRANSPARENT AREA AND LIQUID EJECTION APPARATUS INCLUDING LIQUID CONTAINER WITH VISUAL RECOGNITION PORTION

TECHNICAL FIELD

The present invention relates to a liquid container and a liquid ejection apparatus.

BACKGROUND ART

An inkjet printer that is one type of a liquid ejection apparatus performs printing on a printing medium such as printing paper by ejecting ink that is one example of a liquid from a record head onto the printing medium. A conventionally known configuration of this inkjet printer includes an ink tank as one example of a liquid container (see, for example, Patent Literature 1). In the inkjet printer provided with the ink tank, ink contained in the ink tank is supplied to the record head.

CITATION LIST

Patent Literature

PTL 1: JP 2003-205624A

SUMMARY

Technical Problem

Patent Literature 1 mentioned above discloses a configuration that part of the ink tank is transparent in one side face of the inkjet printer. In the inkjet printer disclosed in Patent Literature 1, the remaining amount of ink in the ink tank is visible from the side face of the inkjet printer. In this ink tank, however, in some attitude, while the remaining amount is visually recognizable through an area ST that allows for visual recognition of the remaining amount of ink (hereinafter called visual recognition area), ink may not reach a supply port EX on an opposite side to the visual recognition area ST, as shown in FIG. 14A. In this case, no ink is supplied from the supply port EX to the record head.

In this ink tank, in some attitude, while the remaining amount is not visually recognizable through the visual recognition area ST and is thus determined to be insufficient, ink may be actually left on the side of the supply port EX, as shown in FIG. 14B. Accordingly the conventional liquid container has difficulty in accurate recognition of the remaining amount of the liquid. This problem is not limited to the liquid container that contains ink and its corresponding liquid ejection apparatus, but is commonly found in any liquid container that contains any liquid other than ink.

Solution to Problem

In order to solve at least part of the problems described above, the invention may be implemented by the following aspects or embodiments.

[Aspect 1]

A liquid container comprises a casing that has a side wall surrounding a container portion configured to contain a liquid; a projecting portion that is provided inside of the container portion to be protruded vertically upward from a bottom of the container portion; and an outlet port that is provided in the casing, that is communicated with outside of the casing through an outer area outside of an overlapping area which overlaps the projecting portion in the container portion in a planar view and that discharges the liquid from the container portion. An area of the side wall, including at least part of an opposed area that is opposed to the projecting portion across a space, has optical transparency.

In the liquid container of this aspect, the projecting portion is provided in the container portion to be protruded from the bottom. This projecting portion raises the liquid in the container portion. This is likely to heighten the position of liquid level of the liquid in the container portion. In this liquid container, the outlet port provided to discharge the liquid from the container portion to outside of the casing communicates with outside of the casing through the outer area outside of the overlapping area that overlaps the projecting portion in the container portion in the planar view. This configuration causes the raised liquid to be discharged out of the casing. In this liquid container, the area of the side wall including at least part of the opposed area that is opposed to the projecting portion across the space has optical transparency, so that the raised liquid is visible through the area having optical transparency. This facilitates recognition of the remaining amount of the liquid in the container portion. More specifically, the configuration of the liquid container raises the liquid in the container portion and is thus likely to discharge the raised liquid out of the casing and to make the remaining amount of the raised liquid readily recognizable from outside of the casing.

[Aspect 2]

In the liquid container of the above aspect, the outlet port may be provided on a side of the bottom to be below a top of the projecting portion.

In this aspect, the outlet port is provided on the side of the bottom to be below the top of the projecting portion and is thus likely to discharge the liquid remaining in the container portion to outside of the casing.

[Aspect 3]

In the liquid container of the above aspect, the side wall may comprise a first side wall that is provided with the outlet port, and a second side wall that is arranged to face the first side wall across the projecting portion. An area of the second side wall including at least part of an opposed area that is opposed to the projecting portion across a space may have optical transparency.

This aspect provides the liquid container having the projecting portion that is placed between the first side wall and the second side wall opposed to each other. This configuration enables the remaining amount of the liquid accumulated in the space between the second side wall and the projecting portion to be visually recognized through the second side wall.

[Aspect 4]

In the liquid container of the above aspect, the first side wall may be continuous with the projecting portion.

In this aspect, the first side wall and the projecting portion are continuous with each other. This is likely to increase the ratio of the area of the projecting portion to the area of the bottom in the planar view and is thus more likely to raise the liquid in the container portion.

[Aspect 5]

In the liquid container of the above aspect, the first side wall may have a clearance from the projecting portion.

In this aspect, the first side wall has a clearance from the projecting portion. This configuration is likely to accumulate the liquid between the first side wall and the projecting portion.

[Aspect 6]

According to another aspect, there is provided a liquid ejection apparatus. The liquid ejection apparatus may comprise a tank that is configured to contain a liquid; a liquid ejection head that is configured to be communicable with the tank via a supply tube; and a housing that is provided to place the tank inside thereof. The tank may comprise a container portion configured to contain the liquid, an inlet port provided to pour the liquid into the container portion and an outlet port provided to supply the liquid through the supply tube to the liquid ejection head. The container portion may comprise a side wall, a bottom and a projecting portion that is provided inside of the container portion to be protruded vertically upward from the bottom. At least part of the side wall may form a visual recognition portion that overlaps a window of the housing. A first portion of the bottom may form a first liquid reservoir that is visible from the visual recognition portion.

In the liquid ejection apparatus of this aspect, the projecting portion is provided in the container portion to be protruded from the bottom. Providing the projecting portion decreases the surface area of the bottom in the container portion. This configuration accordingly raises the liquid in the first liquid reservoir that is a portion of the bottom. Even when the liquid ejection apparatus is inclined to cause the liquid to slightly flow out of the first liquid reservoir, this configuration leaves the liquid in the first liquid reservoir at a visually recognizable level.

[Aspect 7]

In the liquid ejection apparatus of the above aspect, a second portion of the bottom may form a second liquid reservoir that communicates with the outlet port. The first liquid reservoir and the second liquid reservoir may communicate with each other via a communication path that is provided inside of the container portion to be located vertically below a top of the projecting portion.

In this aspect, the projecting portion is provided in the container portion to be protruded from the bottom. Providing the projecting portion decreases the surface area of the bottom in the container portion. This configuration accordingly raises the liquid in the second liquid reservoir that is a portion of the bottom. Even when the liquid ejection apparatus is inclined to cause the liquid to slightly flow out of the second liquid reservoir, this configuration leaves some liquid in the second liquid reservoir. Even a small amount of remaining liquid is thus dischargeable from the outlet port to outside of the container portion.

[Aspect 8]

According to another aspect, there is provided a liquid ejection apparatus. The liquid ejection apparatus may comprise a tank that is configured to contain a liquid; a liquid ejection head that is configured to be communicable with the tank via a supply tube; and a housing that is provided to place the tank inside thereof. The tank may comprise a container portion configured to contain the liquid, an inlet port provided to pour the liquid into the container portion and an outlet port provided to supply the liquid through the supply tube to the liquid ejection head. The container portion may comprise a side wall, a bottom and a projecting portion that is provided inside of the container portion to be protruded vertically upward from the bottom. At least part of the bottom may form a liquid reservoir that communicates with the outlet port.

In this aspect, the projecting portion is provided in the container portion to be protruded from the bottom. Providing the projecting portion decreases the surface area of the bottom in the container portion. This configuration accordingly raises the liquid in the second liquid reservoir that is a portion of the bottom. Even when the liquid ejection apparatus is inclined to cause the liquid to slightly flow out of the second liquid reservoir, this configuration leaves some liquid in the second liquid reservoir. Even a small amount of remaining liquid is thus dischargeable from the outlet port to outside of the container portion.

[Aspect 9]

In the liquid ejection apparatus of the above aspect, the housing may be provided to place the liquid ejection head inside thereof.

This aspect provides the arrangement that both the liquid ejection head and the tank are placed in the housing and thereby enhances the attachment strength of the tank.

DESCRIPTION OF EMBODIMENTS

Figure 1:
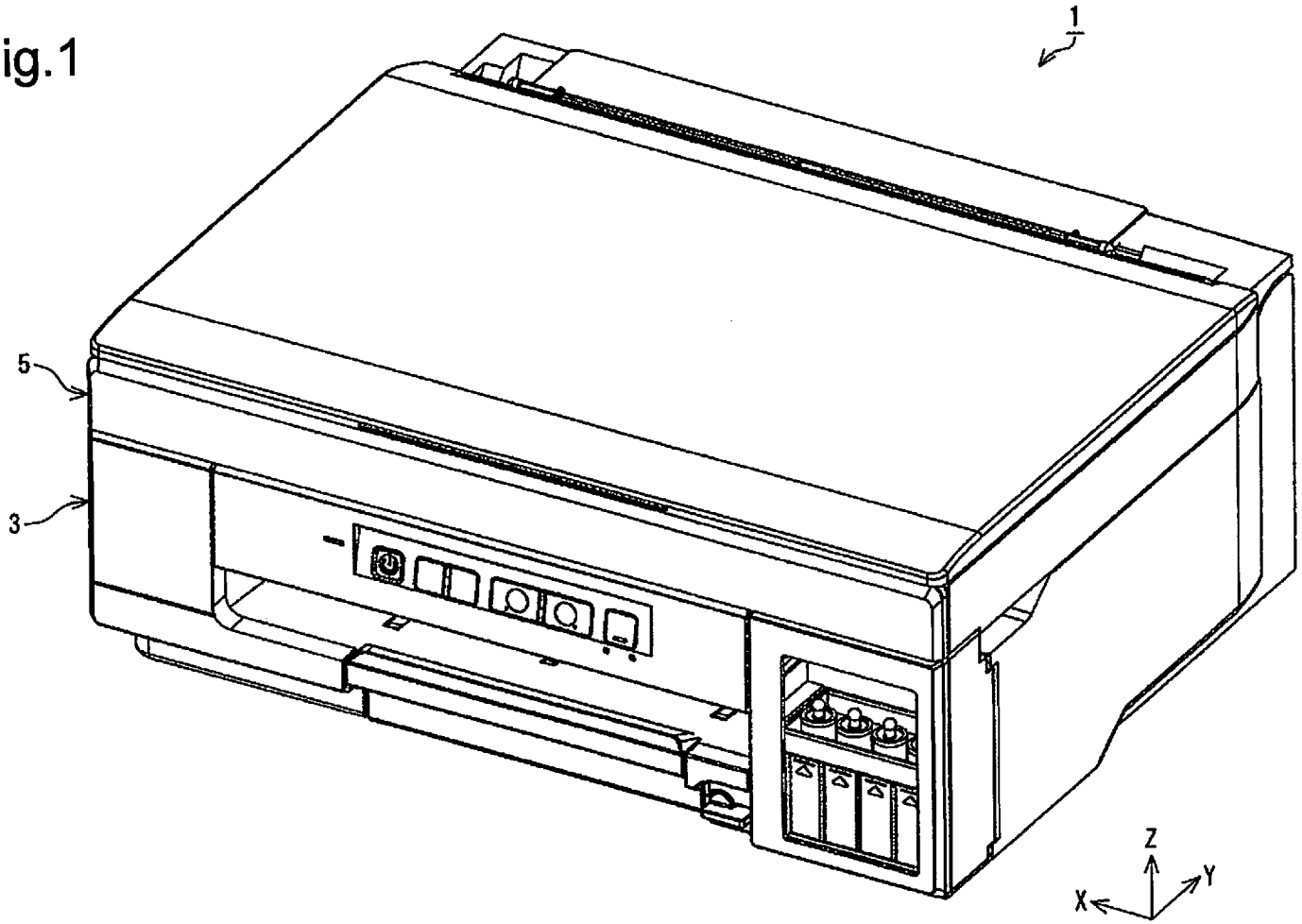
FIG. 1 is a perspective view illustrating a multifunction printer according to an embodiment.

The following describes a multifunction printer as one example of a liquid ejection apparatus according to an embodiment with reference to drawings. The multifunction printer 1 of the embodiment includes a printer 3 and a scanner unit 5 as shown in FIG. 1. In the multifunction printer 1, the printer 3 and the scanner unit 5 are stacked. In the use state of the printer 3, the scanner unit 5 is placed vertically on the printer 3. XYZ axes as coordinate axes that are orthogonal to one another are shown in FIG. 1. The XYZ axes are also added as appropriate in subsequent drawings. In the state of FIG. 1, the printer 3 is placed on a horizontal plane (XY plane) defined by an X-axis direction and a Y-axis direction. A Z-axis direction is a direction orthogonal to the XY plane, and −Z-axis direction represents vertically downward.

Figure 2:
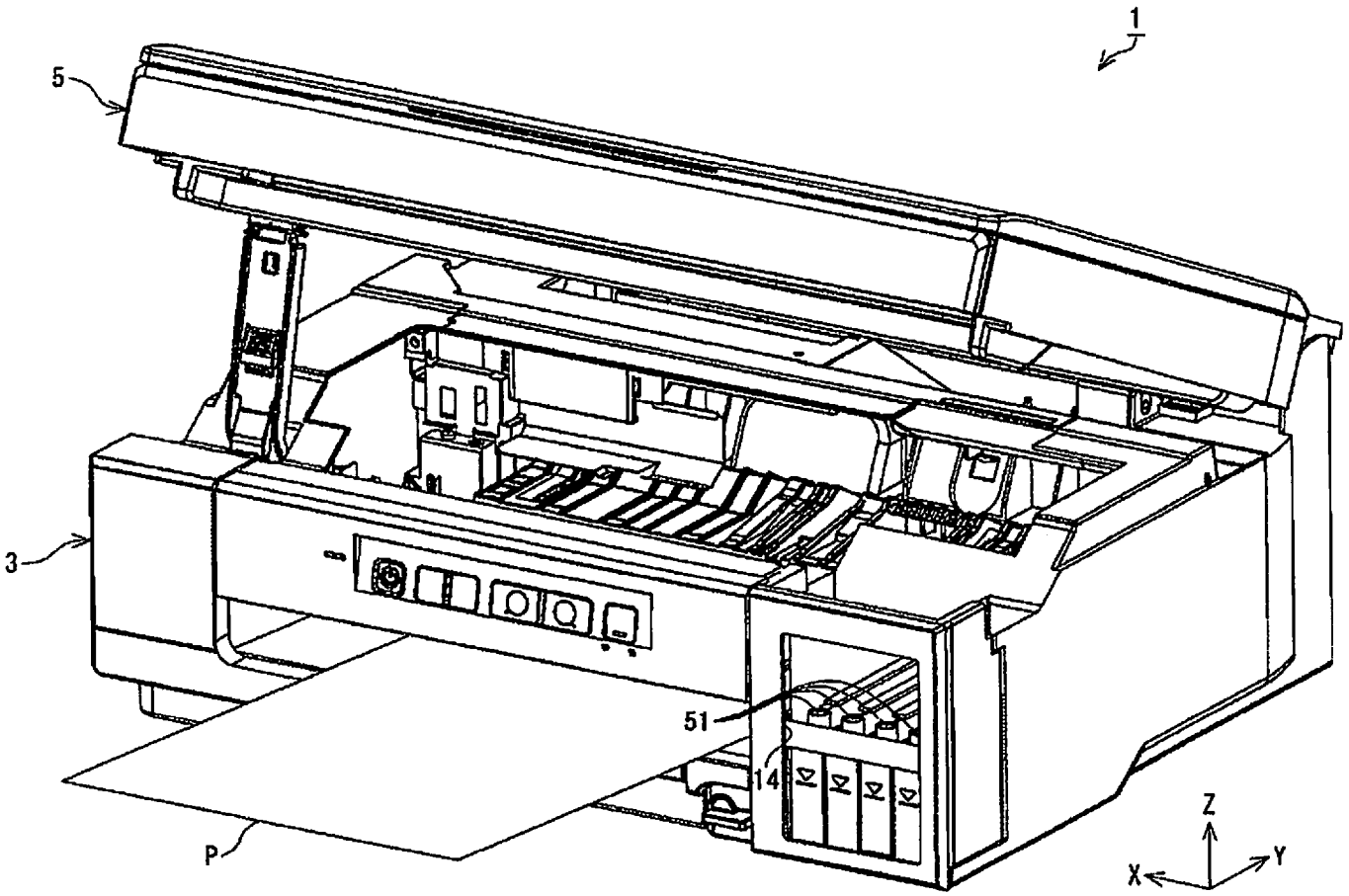
FIG. 2 is a perspective view illustrating the multifunction printer of the embodiment.

The scanner unit 5 is flatbed type having an imaging element (not shown) such as an image sensor, a platen and a cover. The scanner unit 5 is capable of reading an image or the like recorded on a medium such as paper via the imaging element in the form of image data. The scanner unit 5 accordingly serves as a reader of the image or the like. As shown in FIG. 2, the scanner unit 5 is provided to be rotatable relative to a housing 7 of the printer 3. A printer 3-side surface of the platen of the scanner unit 5 also serves as a cover of the printer 3 to cover the housing 7 of the printer 3.

Figure 3:
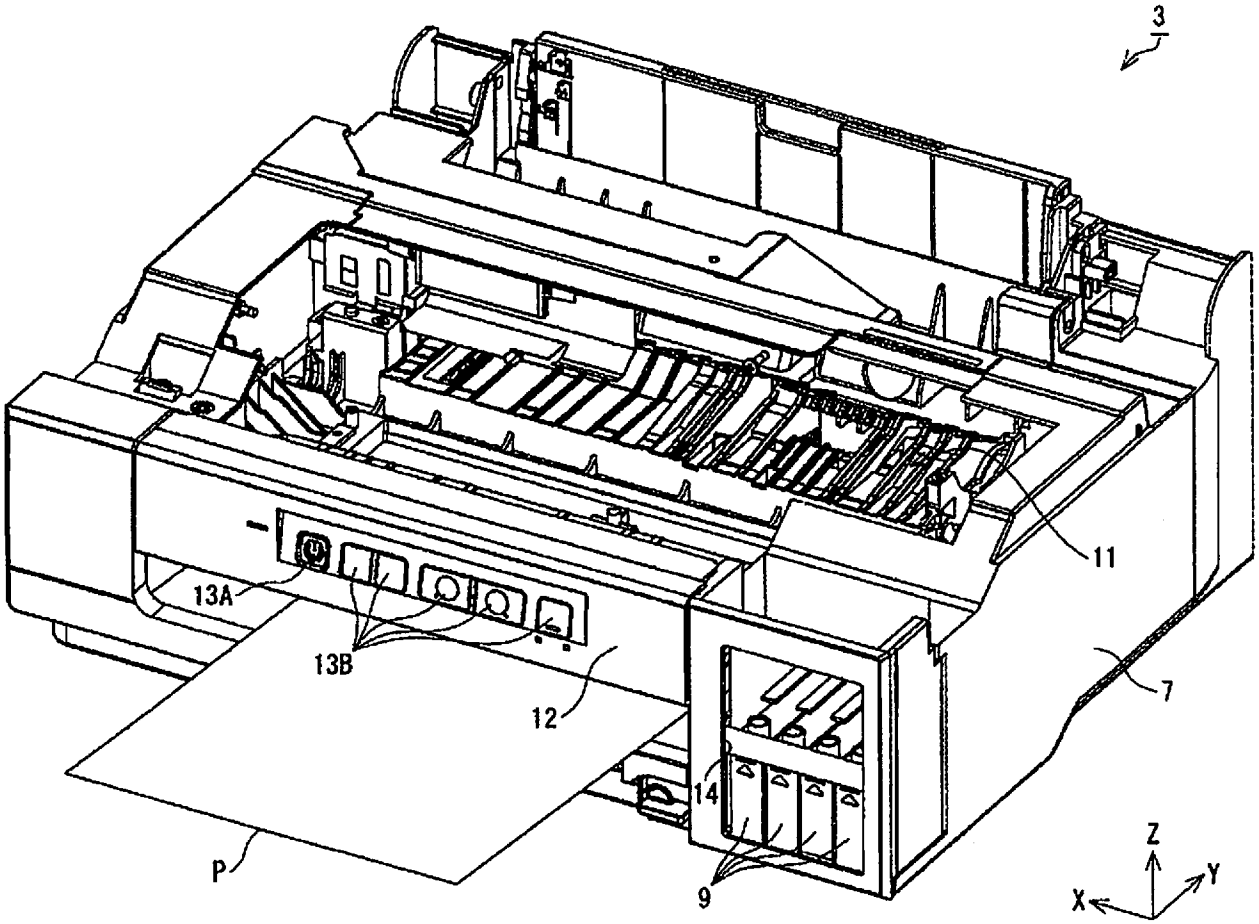
FIG. 3 is a perspective view illustrating a printer of the embodiment.

The printer 3 performs printing on a printing medium P such as printing paper with ink as one example of liquid. As shown in FIG. 3, the printer 3 includes the housing 7 and a plurality of tanks 9. The housing 7 is an integrally molded component that forms an outer shell of the printer 3 and includes mechanics 11 of the printer 3. The plurality of tanks 9 are placed inside of the housing 7 to respectively contain inks used for printing. This provides the arrangement that both the mechanics 11 including a liquid ejection head and the tanks 9 are placed in the housing 7 and thereby enhances the attachment strength of the tanks 9.

According to this embodiment, four tanks 9 are provided. The four tanks 9 respectively contain different inks. This embodiment employs four different inks, i.e., black, yellow, magenta and cyan. Each of the four tanks 9 is provided to contain a different ink.

The printer 3 also has an operation panel 12. The operation panel 12 is provided with a power button 13A and other operation buttons 13B. An operator who operates the printer 3 faces the operation panel 12 to operate the power button 13A and the operation buttons 13B. A front face of the printer 3 is a surface where the operation panel 12 is provided. The housing 7 has a window 14 provided on the front face of the printer 3. The window 14 has optical transparency. The four tanks 9 described above are placed at a position overlapping the window 14. This configuration enables the operator to visually check the four tanks 9 through the window 14.

According to this embodiment, a region of each of the tank 9 facing the window 9 has optical transparency and serves as the visual recognition portion. Ink contained in the tank 9 is visible through the region of the tank 9 having optical transparency. This enables the operator to observe the four tanks 9 through the window 14 and thereby visually check the amounts of inks remaining in the respective tanks 9. According to this embodiment, the window 14 is provided on the front surface of the printer 3. This configuration enables the operator facing the operation panel 12 to visually recognize the respective tanks 9 through the window 14. This accordingly enables the operator to check the remaining amounts of inks in the respective tanks 9 while operating the printer 3.

Figure 4:
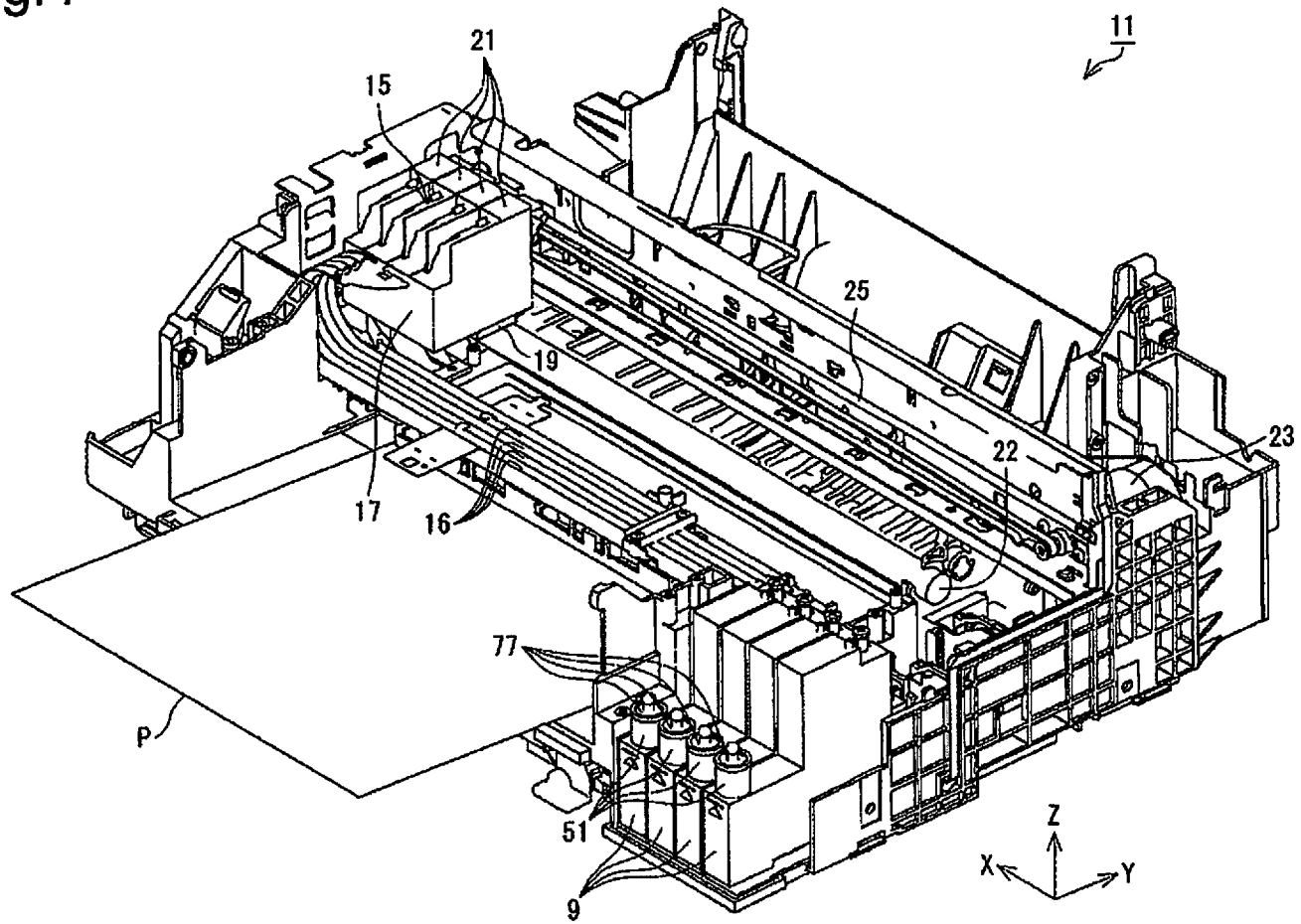
FIG. 4 is a perspective view illustrating mechanics of the printer of the embodiment.

As shown in FIG. 4 that is a schematic diagram of the mechanics 11, the printer 3 includes a liquid ejection assembly 15 and supply tubes 16. The liquid ejection assembly 15 includes a carriage 17, a liquid ejection head 19 and four relay units 21. The liquid ejection head 19 and the four relay units 21 are mounted on the carriage 17. The supply tubes 16 are flexible and are provided between the tanks 9 and the relay units 21. The tank 9 has an inlet port 51 provided with a plug 77 as one example of a sealing member that can seal the inlet port 51. The plug 77 is covered by part of the scanner unit 5 that serves as a cover of the printer 3. The ink contained in each of the tanks 9 is supplied through the supply tube 16 to the relay unit 21. The relay unit 21 relays the ink which is supplied from the tank 9 through the supply tube 16, to the liquid ejection head 19. The liquid ejection head 19 ejects the supplied ink in the form of ink droplets. The cover of the printer 3 to cover over the plug 77 is not limited to the configuration using the platen of the scanner unit 5 but may be a cover of the scanner unit 5 itself.

The printer 3 also has a medium feeding mechanism (not shown) and a head carrying mechanism (not shown). The medium feeding mechanism drives a feed roller 22 by the power from a motor (not shown), so as to feed a printing medium P in the Y-axis direction. The head carrying mechanism transmits the power from a motor 23 via a timing belt 25 to the carriage 17, so as to carry the carriage 17 along the X-axis direction. As described above, the liquid ejection head 19 is mounted on the carriage 17. The liquid ejection head 19 is thus movable in the X-axis direction via the carriage 17 by the head carrying mechanism. The medium feeding mechanism and the head carrying mechanism cause ink to be ejected from the liquid ejection head 19 while changing the position of the liquid ejection head 19 relative to the printing medium P, so as to complete printing on the printing medium P.

FIG. 3 illustrates the housing 7 configured to cover both the liquid ejection head 19 and the tanks 9. The housing 7 is, however, not limited to this configuration but may be configured to include a first housing covering the liquid ejection head 19 and a second housing covering the tanks 9.

First Embodiment

Figure 5:
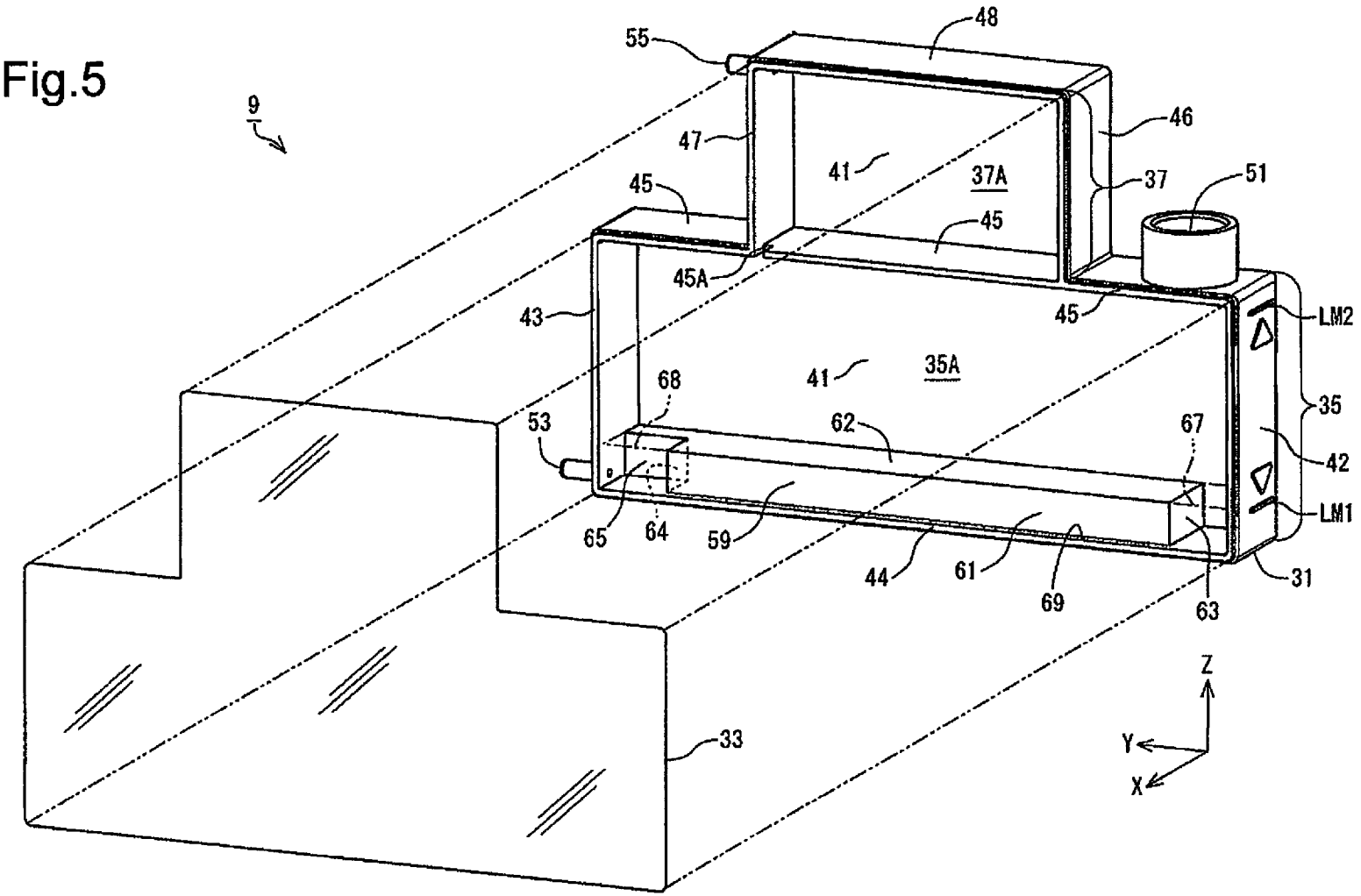
FIG. 5 is an exploded perspective view illustrating the schematic configuration of a tank according to a first embodiment.

The tank 9 has a casing 31 and a sheet member 33 as shown in FIG. 5. The casing 31 is made of a synthetic resin such as nylon or polypropylene. The sheet member 33 is made of a synthetic resin (for example, nylon or polypropylene) in a film-like shape and has flexibility. The casing 31 includes a container portion 35 and an air chamber 37.

The container portion 35 includes first wall 41, a second wall 42, a third wall 43, a fourth wall 44 and a fifth wall 45. The second wall 42, the third wall 43, the fourth wall 44 and the fifth wall 45 are arranged to intersect with the first wall 41 respectively. The second wall 42 and the third wall 43 are located to face each other across the first wall 41 in the Y-axis direction. The fourth wall 44 and the fifth wall 45 are located to face each other across the first wall 41 in the Z-axis direction. The second wall 42 intersects with both the fourth wall 44 and the fifth wall 45. The third wall 43 also intersects with both the fourth wall 44 and the fifth wall 45. In the use state of the printer 3, the fourth wall 44 corresponds to a bottom of the tank 9.

In the printer 3 shown in FIG. 3, the second wall 42 is arranged to face the window 14. The second wall 42 facing the window 14 has optical transparency and serves as the visual recognition portion. The optical transparency of the second wall 42 is only necessary to make the liquid level of ink in the container portion 35 visible via the second wall 42. This configuration enables the operator to visually check the remaining amount of ink in the tank 9 via the window 14 and the second wall 42. According to this embodiment, the tank 9 including the second wall 42 is made of a material having optical transparency.

In the planar view, the first wall 41 shown in FIG. 5 is surrounded by the second wall 42, the third wall 43, the fourth wall 44 and the fifth wall 45. The second wall 42, the third wall 43, the fourth wall 44 and the fifth wall 45 are protruded from the first wall 41 in the +X-axis direction. Accordingly, the container portion 35 is formed in a recessed shape by the first wall 41 as bottom as well as the second wall 42, the third wall 43, the fourth wall 44 and the fifth wall 45. A recess 35A is formed by the first wall 41, the second wall 42, the third wall 43, the fourth wall 44 and the fifth wall 45. The recess 35A is formed to be concave in the −X-axis direction. The recess 35A is open in the +X-axis direction, i.e., on the sheet member 33-side. Ink is contained in the recess 35A.

The air chamber 37 is provided on an opposite side to the recess 35A-side of the fifth wall 45. The air chamber 37 is protruded from the fifth wall 45 on an opposite side to the fourth wall 44-side of the fifth wall 45, i.e., on the +Z-axis direction side of the fifth wall 45. The air chamber 37 includes a first wall 41, the fifth wall 45, a sixth wall 46, a seventh wall 47 and an eighth wall 48. The first wall 41 of the container portion 35 is identical with the first wall 41 of the air chamber 37. In other words, according to this embodiment, the container portion 35 and the air chamber 37 share the first wall 41. The container portion 35 and the air chamber 37 also hare part of the fifth wall 45.

The sixth wall 46 is protruded from the fifth wall 45 on the opposite side to the fourth wall 44-side of the fifth wall 45, i.e., on the +Z-axis direction side of the fifth wall 45. The seventh wall 47 is protruded from the fifth wall 45 on the opposite side to the fourth wall 44-side of the fifth wall 45, i.e., on the +Z-axis direction side of the fifth wall 45. The sixth wall 46 and the seventh wall 47 are located to face each other across the first wall 41 of the air chamber 37 in the Y-axis direction. The eighth wall 48 is located to face the fifth wall 45 across the first wall 41 of the air chamber 37 in the Z-axis direction. The sixth wall 46 intersects both the fifth wall 45 and the eighth wall 48. The seventh wall 47 also intersects both the fifth wall 45 and the eighth wall 48.

In the planar view, the first wall 41 of the air chamber 37 is surrounded by the fifth wall 45, the sixth wall 46, the seventh wall 47 and the eighth wall 48. The fifth wall 45, the sixth wall 46, the seventh wall 47 and the eighth wall 48 are protruded from the first wall 41 in the +X-axis direction. Accordingly, the air chamber 37 is formed in a recessed shape by the first wall 41 as bottom and the fifth wall 45, the sixth wall 46, the seventh wall 47 and the eighth wall 48. A recess 37A of the air chamber 37 is formed by the first wall 41, the fifth wall 45, the sixth wall 46, the seventh wall 47 and the eighth wall 48. The recess 37A is formed to be concave in the −X-axis direction. The recess 37A is open in the +X-axis direction, i.e., on the sheet member 33-side. The recess 35A and the recess 37A are separated from each other by the fifth wall 45. The amounts of protrusion of the second wall 42 to the eighth wall 48 from the first wall 41 are set to an identical protrusion amount, except a cutout 45A of the fifth wall 45. The cutout 45A of the fifth wall 45 is located on the first wall 41-side of a sheet member 33-side end of the fifth wall 45.

The second wall 42 and the sixth wall 46 form a step in the Y-axis direction. The sixth wall 46 is located on the third wall 43-side of the second wall 42, i.e., on the +Y-axis direction side of the second wall 42. The third wall 43 and the seventh wall 47 form a step in the Y-axis direction. The seventh wall 47 is located on the second wall 42-side of the third wall 43, i.e., on the −Y-axis direction side of the third wall 43. In the planar view of the first wall 41, an inlet port 51 is provided in the fifth wall 45 between the second wall 42 and the sixth wall 46. A supply port 53 is provided in the third wall 43. An air communication port 55 is provided in the seventh wall 47. The inlet port 51 and the supply port 53 are respectively arranged to make outside of the casing 31 communicate with inside of the recess 35A. The air communication port 55 is arranged to make outside of the casing 31 communicate with inside of the recess 37A.

A projecting portion 59 is provided inside of the recess 35A. The projecting portion 59 is provided on the fifth wall 45-side of the fourth wall 44. The projecting portion 59 is protruded vertically upward to be convex from the fourth wall 44 as the bottom of the tank 9 toward the fifth wall 45. The projecting portion 59 is extended along the fourth wall 44, i.e., in the Y-axis direction. According to this embodiment, the projecting portion 59 is continuous with the first wall 41. In other words, according to this embodiment, the projecting portion 59 is regarded to be protruded from the first wall 41 toward the sheet member 33, i.e., from the first wall 41 in the +X-axis direction. The amount of protrusion of the projecting portion 59 in the X-axis direction from the first wall 41 is smaller than the protrusion amounts of the second wall 42 to the eighth wall 48.

The projecting portion 59 has a first surface 61, a second surface 62, a third surface 63, a fourth surface 64 and a fifth surface 65. The first surface 61 faces the +X-axis direction to be opposed to the sheet member 33. The first surface 61 intersects with the fourth wall 44. The second wall 62 faces the +Z-axis direction to be opposed to the fifth wall 45. The second surface 62 intersects with the first wall 41, the third wall 43 and the first surface 61. There is a space between the second surface 62 and the fifth wall 45. The third surface 63 faces the −Y-axis direction to be opposed to the second wall 42. The third surface 63 intersects the first wall 41, the fourth wall 44, the first surface 61 and the second surface 62. There is a space between the third surface 63 and the second wall 42.

The fourth surface 64 faces the +Y-axis direction to be opposed to the third wall 43. The fourth surface 64 intersects with the fourth wall 44, the first surface 61 and the second surface 62. There is a space between the fourth surface 64 and the third wall 43. The fifth surface 65 faces the +X-axis direction to be opposed to the sheet member 33. The fifth surface 65 intersects with the third wall 43, the fourth wall 44, the second surface 62 and the fourth surface 64. The fifth surface 65 and the first surface 61 form a step. The fifth surface 65 is located on the first wall 41-side of the first surface 61 in the X-axis direction. In the use state of the printer 3, the second surface 62 located on the fifth wall 45-side of the fourth wall 44 as the bottom of the tank 9 corresponds to the top of the projecting portion 59.

A space in which the third surface 63 overlaps the second wall 42 is provided between the projecting portion 59 and the second wall 42, as a first liquid reservoir 67. According to this embodiment, the second wall 42 opposed to the projecting portion 59 across the first liquid reservoir 67 serves as a visual recognition area to allow for visual recognition of the remaining amount of ink. A space in which the fourth surface 64 overlaps the third wall 43 is provided between the projecting portion 59 and the third wall 43, as a second liquid reservoir 68. The supply port 53 is arranged to make the second liquid reservoir 68 communicate with outside of the casing 31. The supply port 53 is provided in an area of the third wall 43 that overlaps the fourth wall 64. Accordingly, the supply port 53 makes outside of the casing 31 communicate with the second liquid reservoir 68. In other words, the container portion 35 communicates with outside of the casing 31 via the supply port 53 through an outer area outside of an overlapping area that overlaps the projecting portion 59 in the container portion 35 in the planar view of the fourth wall 44. Additionally, the supply port 53 is located on the fourth wall 44-side of the second surface 62 which corresponds to the top of the projecting portion 59.

The first liquid reservoir 67 and the second liquid reservoir 68 are terms representing the spaces placed in the container portion 35 as described above. Even when no liquid is present in the container portion 35, these spaces are called first liquid reservoir 67 and second liquid reservoir 68.

As shown in FIG. 5, the sheet member 33 is arranged to face the first wall 41 across the second wall 42 to the eighth wall 48 in the X-axis direction. In the planar view, the sheet member 33 has dimensions to cover the recess 35A and the recess 37A. The sheet member 33 is joined with respective ends of the second wall 42 to the eighth wall 48 with keeping a clearance from the first wall 41. The recess 35A and the recess 37A are accordingly sealed by the sheet member 33. The sheet member 33 may thus be regarded as a cover for the casing 31.

In the state that the sheet member 33 is joined with the casing 31, there is a clearance between the sheet member 33 and the cutout 45A. The clearance between the sheet member 33 and the cutout 45A makes the recess 37A and the recess 35A communicate with each other. In the state that the sheet member 33 is joined with the casing 31, there is a clearance between the sheet member 33 and the projecting portion 59. The clearance between the sheet member 33 and the projecting portion 59 connects the first liquid reservoir 57 with the second liquid reservoir 68. In the description below, an area surrounded by the first surface 61 of the projecting portion 59, the fourth wall 44 and the sheet member 33 is called a communication path 69. The communication path 69 is located vertically below the top of the projecting portion 59. The first liquid reservoir 67 and the second liquid reservoir 68 communicate with each other by the communication path 69. A sectional area of the communication path 69 in an XZ plane is smaller than a sectional area of the first liquid reservoir 67 in the XZ plane and a sectional area of the second liquid reservoir 68 in the XZ plane.

Figure 6:
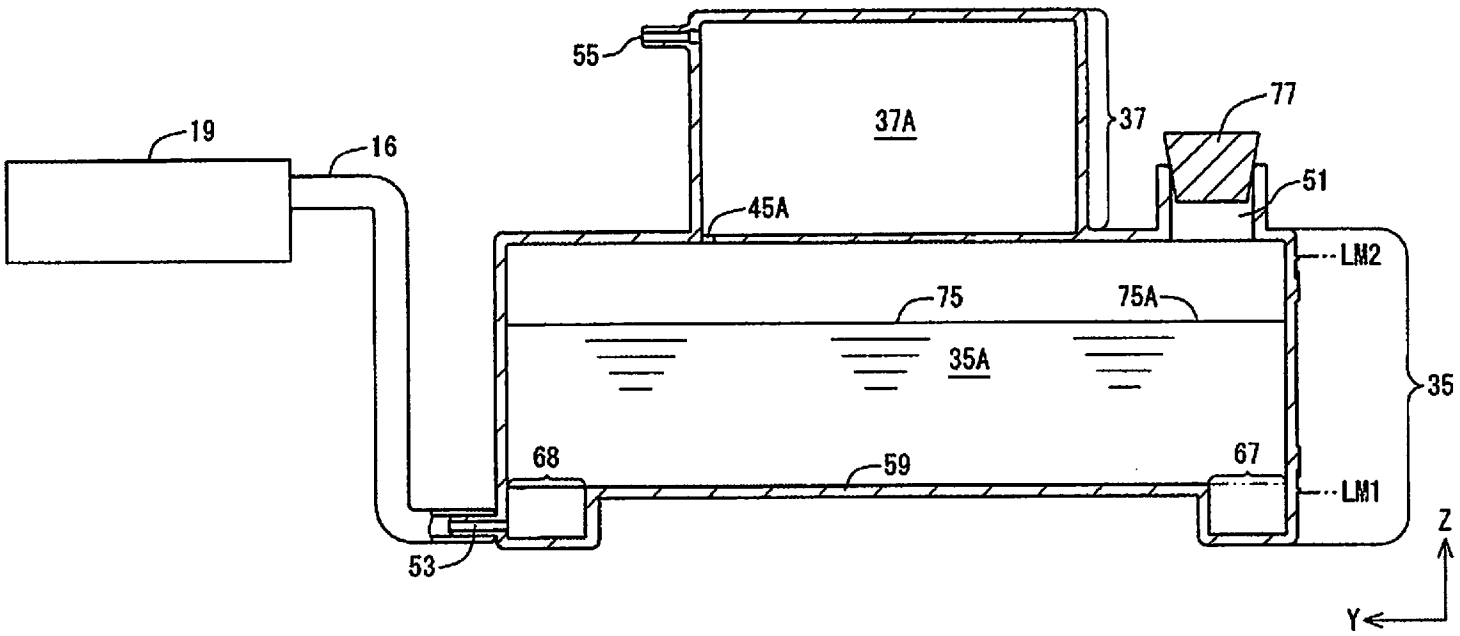
FIG. 6 is a diagram illustrating a flow of ink from the tank to a print head according to the first embodiment.

In the tank 9, as shown in FIG. 6, ink 75 is contained inside of the recess 35A. FIG. 6 illustrates a section of the inlet port 51, the supply port 53 and the air communication port 55 of the tank 9 cut along a YZ plane. According to this embodiment, in the use state of the printer 3 for printing, the supply tube 16 is connected with the supply port 53, and the inlet port 51 is closed by the plug 77. The ink 75 in the recess 35A is supplied from the supply port 53 through the supply tube 16 into the liquid ejection head 19. The ink 75 in the recess 35*a* is fed to the liquid ejection head 19 with progress in printing by means of the liquid ejection head 19. Accordingly, the internal pressure of the recess 35A decreases to be lower than the atmospheric pressure with progress in printing by means of the liquid ejection head 19. As the internal pressure of the recess 35A becomes lower than the atmospheric pressure, the air in the recess 37A is fed into the recess 35A through the cutout 45A. This is likely to maintain the internal pressure of the recess 35A at the atmospheric pressure.

Figure 7:
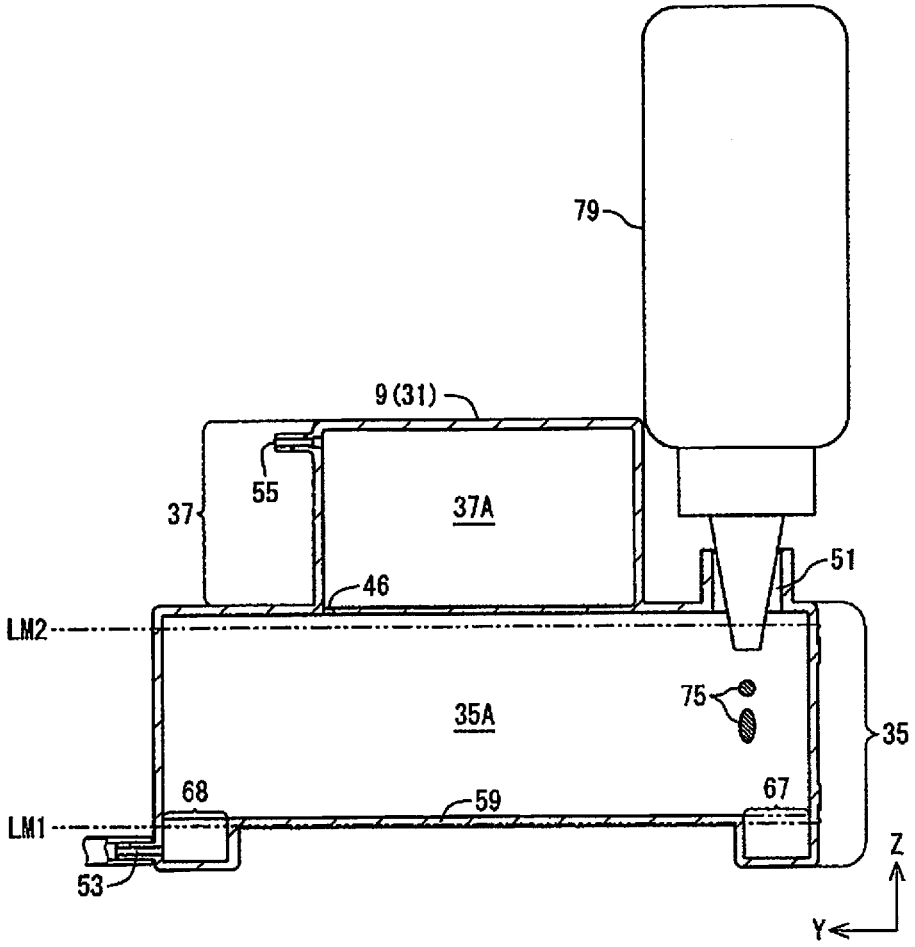
FIG. 7 is a diagram illustrating pouring of ink into the tank according to the first embodiment.

The ink 75 in the tank 9 is supplied to the liquid ejection head 19 as described above. When the ink 75 in the recess 35A of the tank 9 is consumed and the remaining amount of the ink 75 reaches a lower limit, the operator is allowed to refill the tank 9 with ink newly supplied from the inlet port 51. According to this embodiment, as shown in FIG. 5, a lower limit line LM1 and an upper limit lime LM2 are provided on the second wall 42 of the casing 31. The lower limit line LM1 and the upper limit line LM2 are lines indicating the allowable amount of the ink 75 for the tank 9. The lower limit line LM1 indicates a lower limit position of a liquid level 75A of the ink 75 shown in FIG. 6. The upper limit line LM2 indicates an upper limit position of the liquid level 75A. The operator recognizes that the amount of the ink 75 in the tank 9 reaches the lower limit of the allowable range, on the basis of that the liquid level 75A of the ink 75 reaches the lower limit line LM1. Based on such recognition, the operator opens the scanner unit 5 as shown in FIG. 2 and pours new ink 75 from, for example, a bottle 109 filled with new ink 75 through the inlet port 51 into the tank 9 as shown in FIG. 7.

The configuration of refilling the ink 75 is, however, not limited to this configuration, but the window 14 may be configured to be openable and closable relative to the tank 9 in FIG. 2. Opening the window 14 facilitates the bottle 109 to be placed for refilling the ink 75.

According to this embodiment, the supply port 53 corresponds to the outlet port, the third wall 43 corresponds to the first side wall, and the second wall 42 corresponds to the second side wall.

According to this embodiment, the ink 75 in the container portion 35 is visible through the second wall 42 of the tank 9. The window 14 provided in the housing 7 of the printer 3 overlaps the second wall 42 of the tank 9, so that the liquid level 75A of the ink 75 in the container portion 35 is visible from outside of the housing 7. Accordingly, the configuration of this printer 3 enables the remaining amount of the ink 75 in the tank 9 to be visually recognized from outside of the housing 7.

Figure 8A:
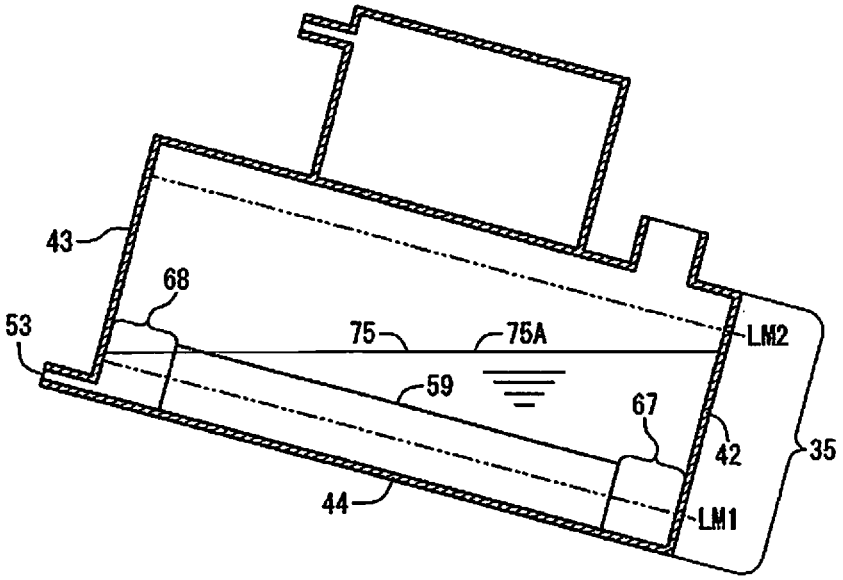
FIGS. 8A and 8B are diagrams illustrating advantageous effects of the first embodiment.
Figure 8B:
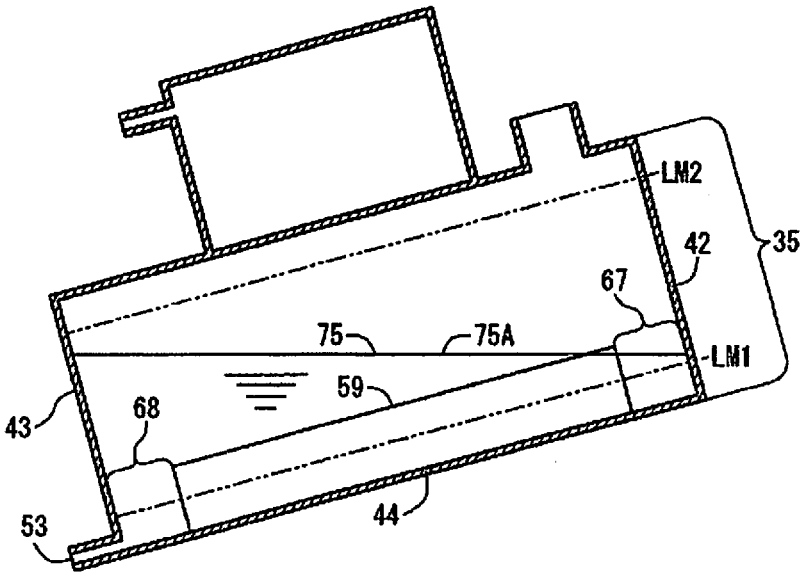

According to this embodiment, the projecting portion 59 protruded from the fourth wall 44 that is the bottom of the tank 9 is provided in the container portion 35. The projecting portion 59 raises the ink 75 in the container portion 35 and is thus likely to heighten the position of the liquid level 75A of the ink 75 in the container portion 35. For example, even when the attitude of the tank 9 is inclined such that the second wall 42 is lower than the third wall 43 in the vertical direction as shown in FIG. 8A, this configuration makes the ink 75 likely to reach the supply port 53. In another example, when the attitude of the tank 9 is inclined such that the third wall 43 is lower than the second wall 42 in the vertical direction as shown in FIG. 8B, on the contrary, this configuration makes the position of the liquid level 75A likely to be higher than the lower limit line LM1. As a result, the configuration of this embodiment enables the remaining amount of the ink 75 in the tank 9 to be accurately recognized.

In this tank 9, the supply port 53 provided to discharge the ink 75 from the container portion 35 to outside of the casing 31 communicates with outside of the casing 31 through the outer area outside of the overlapping area that overlaps the projecting portion 59 in the container portion 35 in the planar view of the fourth wall 44. This configuration causes the ink 75 raised by the projecting portion 59 to be discharged out of the casing 31.

In this tank 9, the second wall 42 has optical transparency, so that the raised ink 75 is visible through an area having optical transparency. This facilitates recognition of the remaining amount of the ink 75 in the container portion 35. More specifically, the configuration of this tank 9 raises the ink 75 in the container portion 35 and is thus likely to discharge the raised ink 75 out of the casing 31 and to make the remaining amount of the raised ink 75 readily recognizable from outside of the casing 31. As a result, this enables the remaining amount of the ink 75 in the tank 9 to be recognized accurately.

According to this embodiment, the supply port 53 is located on the fourth wall 44-side of the second surface 62 that corresponds to the top of the projecting portion 59. In other words, the supply port 53 is located on the side of the bottom to be below the top of the projecting portion 59. This configuration is more likely to discharge the ink 75 remaining in the container portion 35 to outside of the casing 31.

According to this embodiment, the projecting portion 59 is continuous with the third wall 43. This configuration is likely to increase the ratio of the area of the projecting portion 59 to the area of the fourth wall 44 in the planar view of the fourth wall 44 and is thus more likely to raise the ink 75 in the container portion 35.

According to this embodiment, the first liquid reservoir 67 is provided between the projecting portion 59 and the second wall 42, and the second liquid reservoir 68 is provided between the projecting portion 59 and the third wall 43. The ink 75 is thus likely to be accumulated in the first liquid reservoir 67 and the second liquid reservoir 68. This configuration enables the ink 75 accumulated in the first liquid reservoir 67 to be visible from the visual recognition portion of the liquid ejection apparatus through the second wall 42, while enabling the ink 75 accumulated in the second liquid reservoir 68 to be discharged from the supply port 53.

The joint position at which the supply port 53 is connected with the supply tube 16 is located on the bottom side to be lower than the top of the projecting portion 59 in FIG. 6. The joint position is, however, not limited to this configuration but may be located at a higher position than the top of the projecting portion 59. For example, in FIGS. 8A and 8B, the supply port 53 may be extended along the third wall 43 toward the upper limit line LM2 to be higher than the top of the projecting portion 59. The second liquid reservoir 68 at which the supply port 52 is connected with the container portion 35 should, however, be located on the bottom side to be lower than the top of the projecting portion 59.

Second Embodiment

Figure 9:
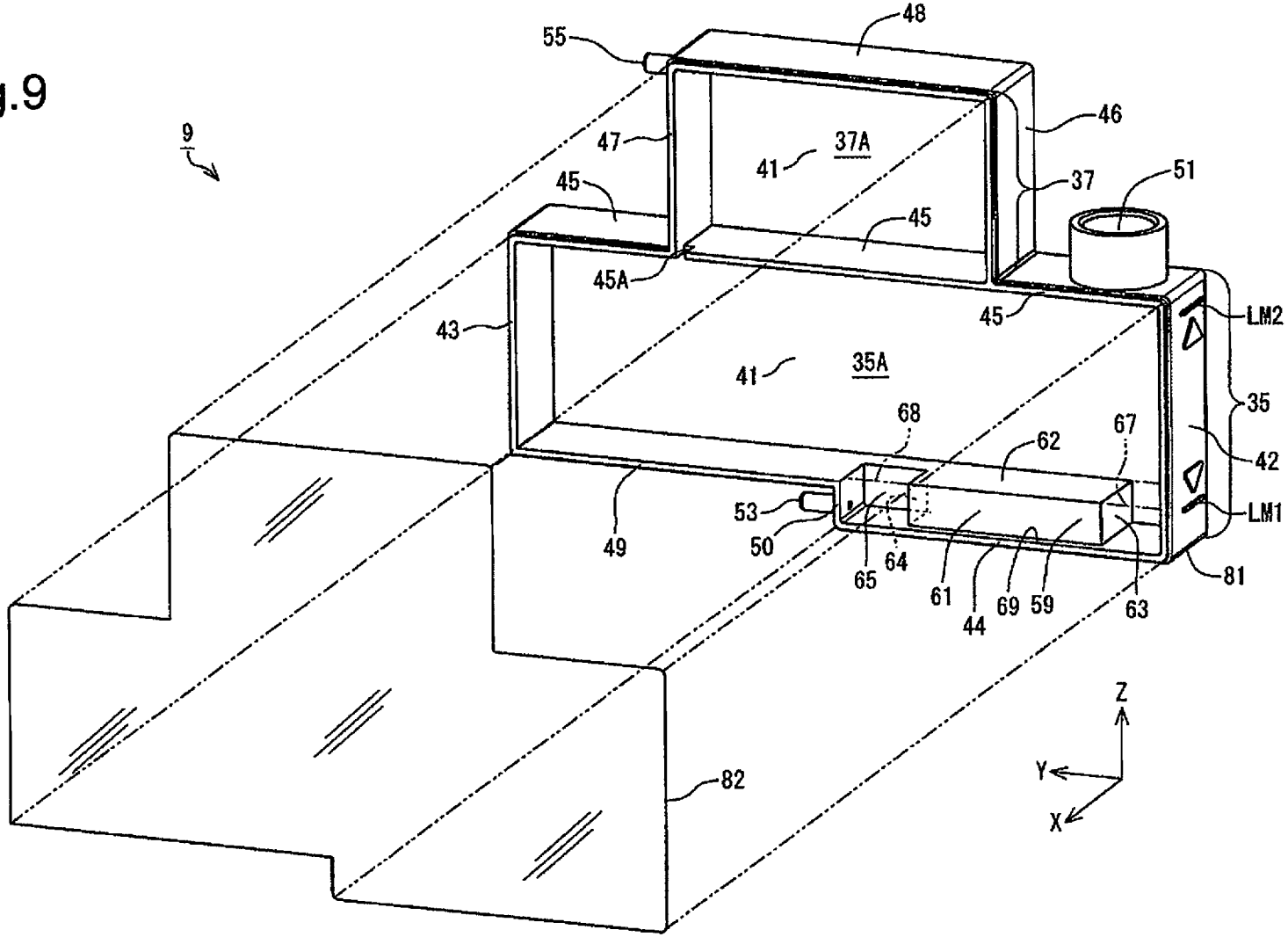
FIG. 9 is an exploded perspective view illustrating the schematic configuration of a tank according to a second embodiment.

The following describes a tank 9 according to a second embodiment. The tank 9 of the second embodiment includes a casing 81 and a sheet member 82 as shown in FIG. 9. The casing 81 has a similar configuration to that of the casing 31 of the first embodiment, except the positions of a supply port 53 and a second liquid reservoir 68. The sheet member 82 has a similar configuration to that of the sheet member 33, except its outer shape corresponding to the shape of the casing 81. In the description below, the like components to those of the first embodiment are expressed by the like signs to those of the first embodiment and are not specifically described.

The casing 81 has a ninth wall 49 and a tenth wall 50, in addition to the first wall 41 to the eighth wall 48. In the casing 81, the fourth wall 44 extended in the Y-axis direction starts from the second wall 42 and ends at a position on the second wall 42-side of the third wall 43. In other words, the length of the fourth wall 44 in the Y-axis direction is shorter in the casing 81 than that in the casing 31. Accordingly, the length of the third wall 43 in the Z-axis direction is shorter in the casing 81 than that in the casing 31.

The ninth wall 49 is protruded from the first wall 41 toward the sheet member 82, i.e., from the first wall 41 in the +X-axis direction. The ninth wall 49 is located between the fifth wall 45 and the fourth wall 44 in the Z-axis direction. The ninth wall 49 is arranged to face the fifth wall 45. The ninth wall 49 and the fifth wall 45 are located to be opposed to each other across the first wall 41 in the Z-axis direction. The ninth wall 49 intersects with the first wall 41 and the third wall 43. The ninth wall 49 and the fourth wall 44 form a step in the Z-axis direction. The ninth wall 49 is located on the fifth wall 45-side of the fourth wall 44 in the Z-axis direction.

The tenth wall 50 is protruded from the fifth surface 65 of the projecting portion 59 toward the sheet member 82, i.e., from the fifth surface 65 in the +X-axis direction. The tenth wall 50 is located to face the second wall 42 across the projecting portion 59 in the Y-axis direction. The supply port 53 is provided in the tenth wall 50. The tenth wall 50 intersects with the fourth wall 44 and the ninth wall 49. In the casing 81, in the planar view, a recess 35A is surrounded by the second wall 42, the third wall 43, the fourth wall 44, the fifth wall 45, the ninth wall 49 and the tenth wall 50. A container portion 35 is formed in a recessed shape by the first wall 41 as bottom and the second wall 42, the third wall 43, the fourth wall 44, the fifth wall 45, the ninth wall 49 and the tenth wall 50. In the casing 81, the recess 35A is formed by the first wall 41, the second wall 42, the third wall 43, the fourth wall 44, the fifth wall 45, the ninth wall 49 and the tenth wall 50. In the casing 81, the second liquid reservoir 68 is provided between the projecting portion 59 and the tenth wall 50.

The second embodiment has the similar advantageous effects to those of the first embodiment. Additionally, the distance between the second liquid reservoir 68 and the first liquid reservoir 67 in the Y-axis direction is shorter in the tank 9 of the second embodiment having the above configuration than in the tank 9 of the first embodiment. The shorter length between the second liquid reservoir 68 and the first liquid reservoir 67 is likely to reduce a height difference in the vertical direction between the first liquid reservoir 67 and the second liquid reservoir 68 accompanied with a change in attitude of the tank 9. Reduction of the height difference in the vertical direction between the first liquid reservoir 67 and the second liquid reservoir 68 enables the remaining amount of the ink 75 in the tank 9 to be more accurately recognized.

Figure 10A:
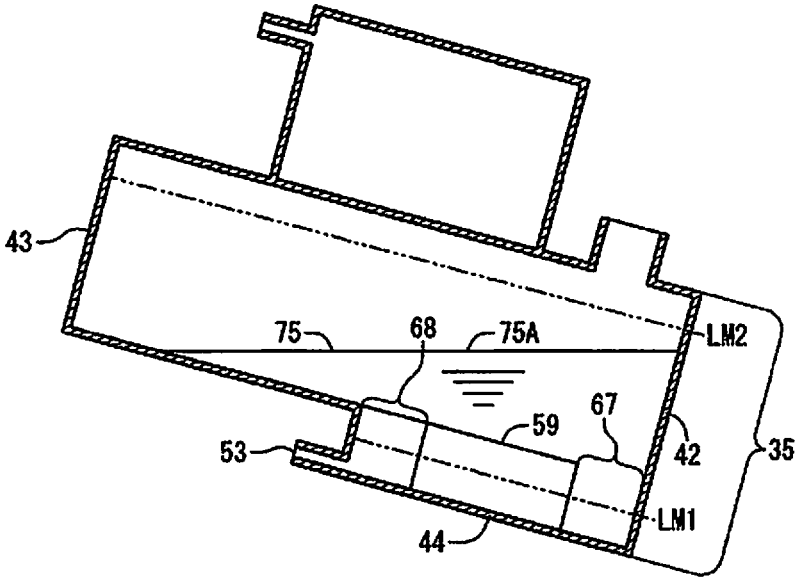
FIGS. 10A and 10B are diagrams illustrating advantageous effects of the second embodiment.
Figure 10B:
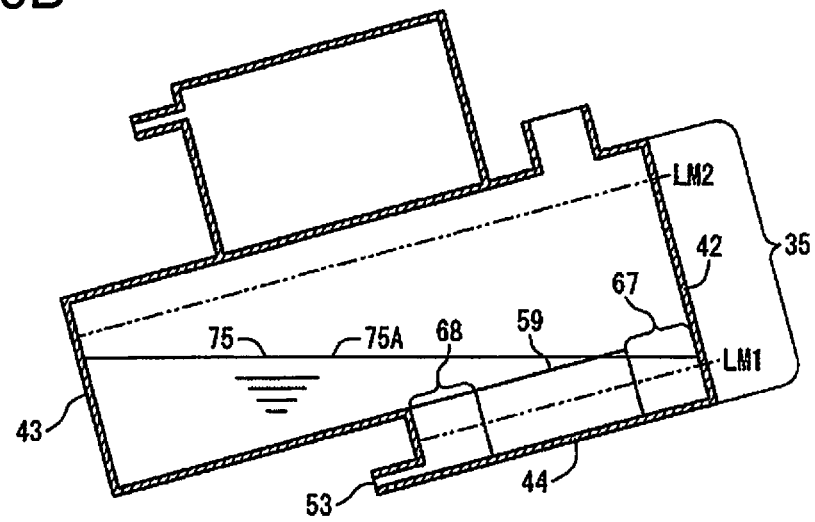

For example, even when the attitude of the tank 9 is inclined such that the second wall 42 is lower than the tenth wall 50 in the vertical direction as shown in FIG. 10A, this configuration is more likely to make the ink 75 reach the supply port 53, compared with the configuration of the first embodiment. In another example, when the attitude of the tank 9 is inclined such that the tenth wall 50 is lower than the second wall 42 in the vertical direction as shown in FIG. 10B, on the contrary, this configuration is more likely to make the position of the liquid level 75A higher than the lower limit line LM1, compared with the configuration of the first embodiment. As a result, the configuration of this embodiment enables the remaining amount of the ink 75 in the tank 9 to be more accurately recognized, compared with the configuration of the first embodiment.

[Modification 1]

Figure 11:
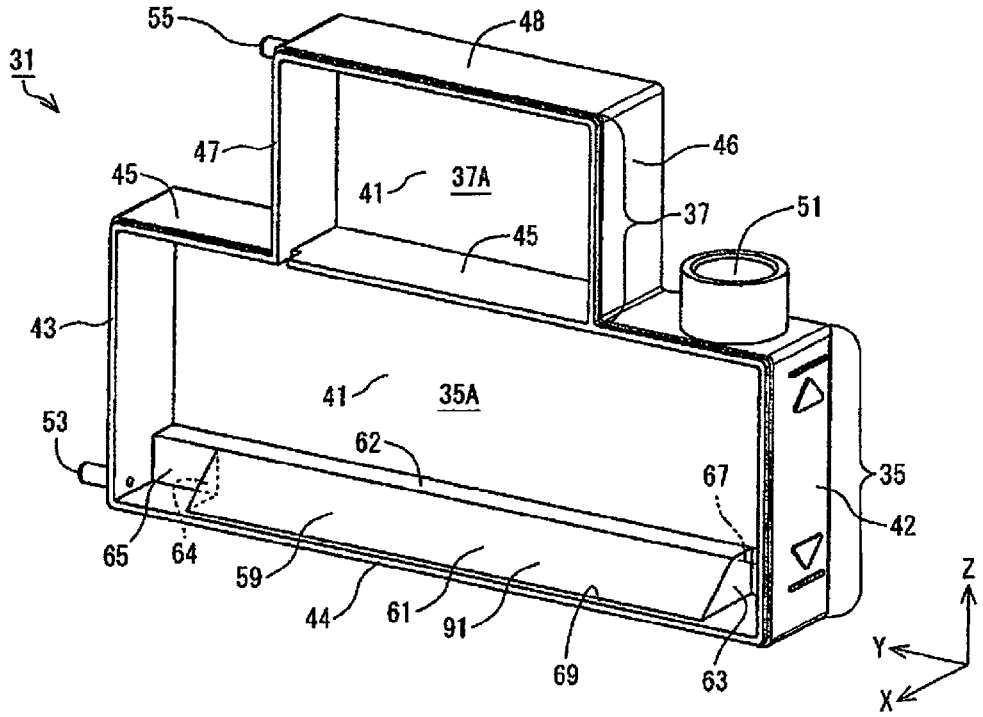
FIG. 11 is a perspective view illustrating a modification of a casing of the embodiment.

In each of the first embodiment and the second embodiment described above, the projecting portion 59 may include an inclined surface 91 that is inclined to the first wall 41 and the fourth wall 44 as shown in FIG. 11. FIG. 11 illustrates a modification of the casing 31. The modification illustrated in FIG. 11 is, however, also applicable to the casing 81. In the illustrated example of FIG. 11, the first surface 61 forms the inclined surface 91. The inclined surface 91 is, however, not limited to the first surface 61 but may be employed for any of the first surface 61 to the fifth surface 65. The number of inclined surfaces 91 is not limited to one, but the inclined surface 91 may be employed for a plurality of surfaces constituting the projecting portion 59. Moreover, all the first surface 61 to the fifth surface 65 may be inclined surfaces 91.

[Modification 2]

Figure 12:
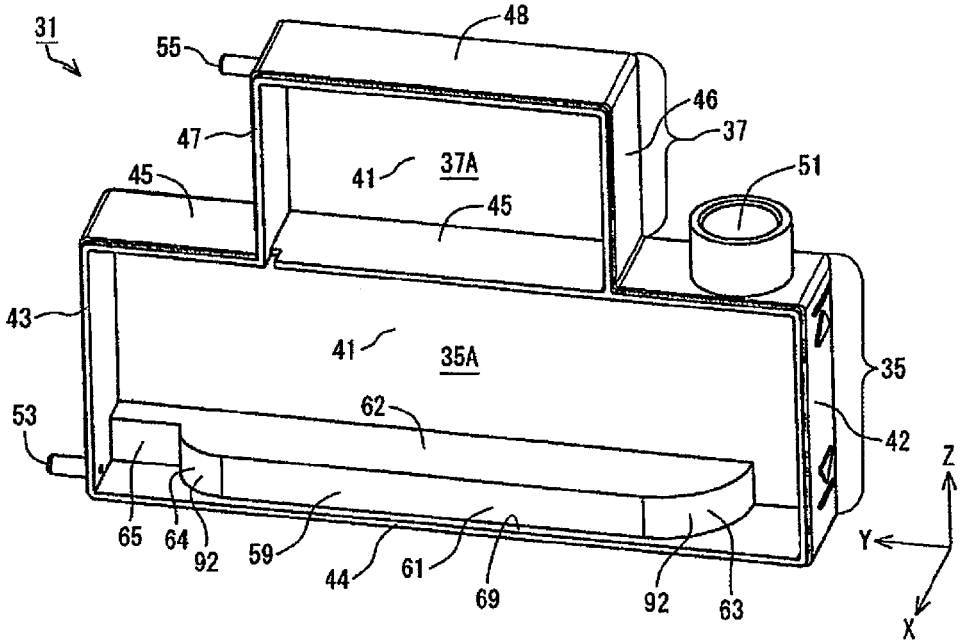
FIG. 12 is a perspective view illustrating another modification of the casing of the embodiment.

In each of the first embodiment and the second embodiment described above, the projecting portion 59 may include a curved surface 92 as shown in FIG. 12. FIG. 12 illustrates a modification of the casing 31. The modification illustrated in FIG. 12 is, however, also applicable to the casing 81. In the illustrated example of FIG. 12, the third surface 63 and the fourth surface 64 form curved surfaces 92. The curved surface 92 is, however, not limited to the third surface 63 and the fourth surface 64 but may be employed for any of the first surface 61 to the fifth surface 65. The number of curved surfaces 92 is not limited to two, but may be one or may be three or more. Moreover, all the first surface 61 to the fifth surface 65 may be curved surfaces 92.

[Modification 3]

Figure 13:
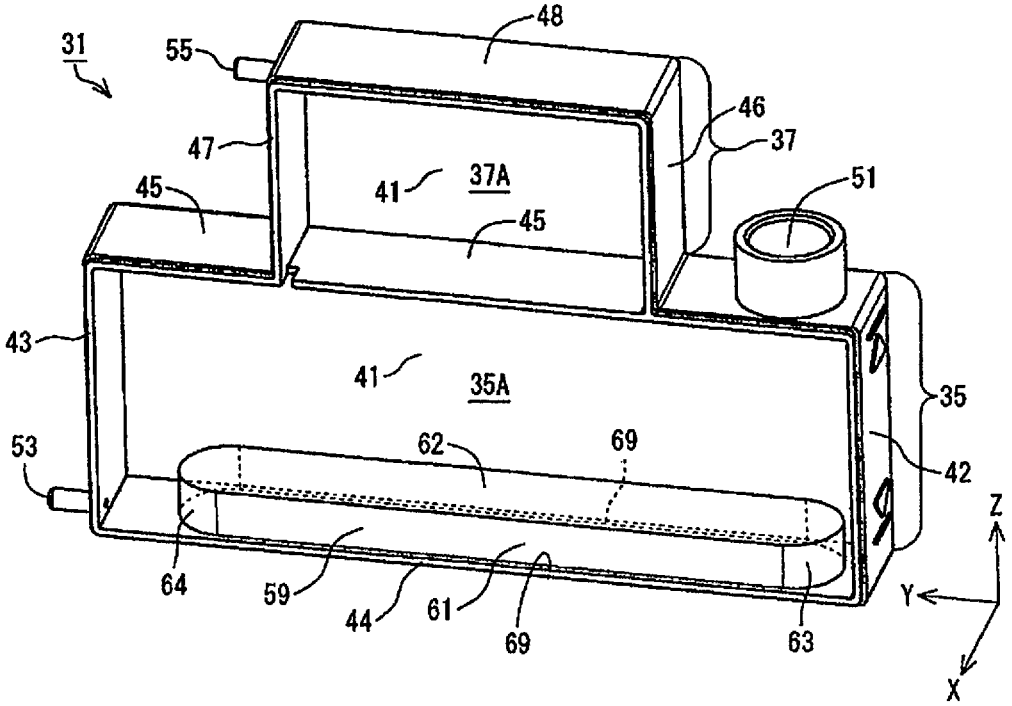
FIG. 13 is a perspective view illustrating yet another modification of the casing of the embodiment.
Figure 14A:
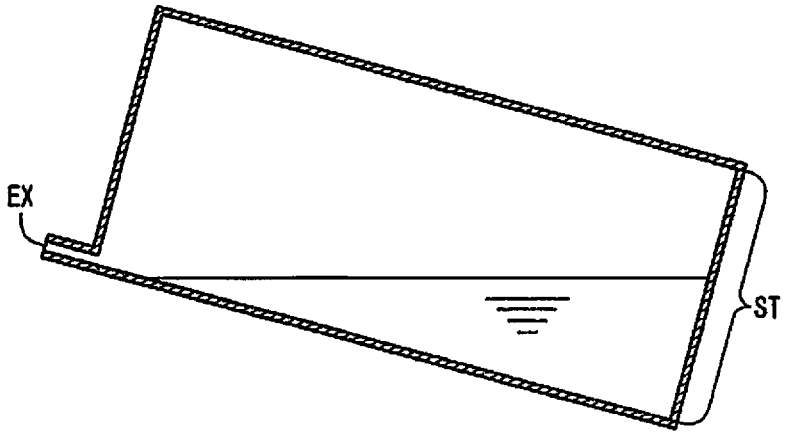
FIGS. 14A and 14B are diagrams illustrating a problem of a prior art.
Figure 14B:
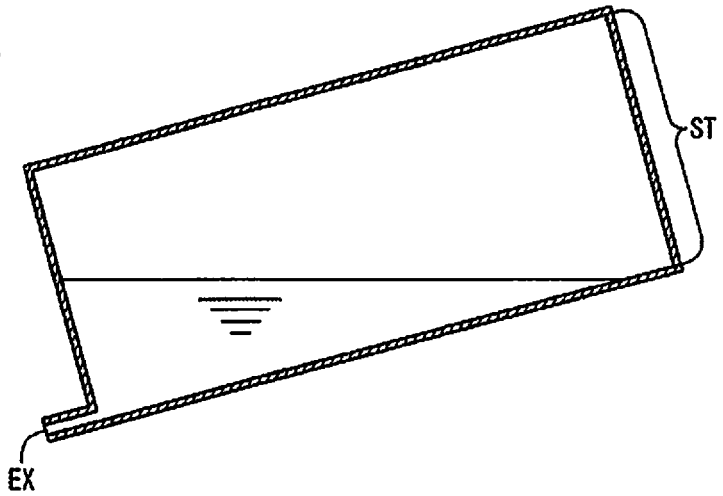
Prior Art Fig. 14B

In each of the first embodiment and the second embodiment described above, the projecting portion 59 may be separated from the first wall 41 as shown in FIG. 13. FIG. 13 illustrates a modification of the casing 31. The modification illustrated in FIG. 13 is, however, also applicable to the casing 81. In the casing illustrated in FIG. 13, there is a space between the projecting portion 59 and the first wall 41. Accordingly, in the casing illustrated in FIG. 13, the projecting portion 59 is formed in an island shape on the fourth wall 44. The space between the projecting portion 59 and the first wall 41 also serves as a communication path 69.

In the respective embodiments described above, the liquid ejection apparatus may be a liquid ejection apparatus that sprays, ejects or applies and thereby consumes a liquid other than ink. The liquid ejected in the form of very small amounts of droplets from the liquid ejection apparatus may be in a granular shape, a teardrop shape or a tapered threadlike shape. The liquid herein may be any material consumed in the liquid ejection apparatus. The liquid may be any material in the liquid phase and may include liquid-state materials of high viscosity or low viscosity, sols, aqueous gels and other liquid-state materials including inorganic solvents, organic solvents, solutions, liquid resins and liquid metals (metal melts). The liquid is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks. A concrete example of the liquid ejection apparatus may be a liquid ejection apparatus that ejects a liquid in the form of a dispersion or a solution containing a material such as an electrode material or a color material used for production of liquid crystal displays, EL (electroluminescent) displays, surface emission displays and color filters. The liquid ejection apparatus may also be a liquid ejection apparatus that ejects a bioorganic material used for manufacturing biochips, a liquid ejection apparatus that is used as a precision pipette and ejects a liquid as a sample, a printing apparatus or a microdispenser. Additionally, the liquid ejection apparatus may be a liquid ejection apparatus for pinpoint ejection of lubricating oil on precision machines such as machines and cameras or a liquid ejection apparatus that ejects a transparent resin solution of, for example, an ultraviolet curable resin, onto a substrate to manufacture a hemispherical microlens (optical lens) used for optical communication elements and the like. As another example, the liquid ejection apparatus may be a liquid ejection apparatus that ejects an acidic or alkaline etching solution to etch a substrate or the like.

REFERENCE SIGNS LIST

1 multifunction printer
3 printer
5 scanner unit
7 housing
9 tank
14 window
15 printing assembly
16 supply tube
17 carriage
19 print head
21 relay unit
31 casing
35A recess
33 sheet member
35 container portion
37 air chamber
37A recess
41 first wall
42 second wall
43 third wall
44 fourth wall
45 fifth wall
45A cutout
46 sixth wall
47 seventh wall
48 eighth wall
49 ninth wall
50 tenth wall
51 inlet port
53 supply port
55 air communication port
59 projecting portion
61 first surface
62 second surface
63 third surface
64 fourth surface
65 fifth surface
67 first liquid reservoir
68 second liquid reservoir
69 communication path
75 ink
75A liquid level
81 casing
82 sheet member
91 inclined surface
92 curved surface
P printing medium

The invention claimed is:

1. A liquid container, comprising:

a casing that has a side wall surrounding a container portion configured to contain a liquid;

a projecting portion that is provided inside of the container portion to be protruded vertically upward from a bottom of the container portion; and an outlet port that is provided in the casing, that is communicated with outside of the casing through an outer area outside of an overlapping area which overlaps the projecting portion in the container portion in a planar view and that discharges the liquid from the container portion, an area of the side wall, including at least part of an opposed area that is opposed to the projecting portion across a space, having optical transparency.

2. The liquid container according to claim 1, the outlet port being provided on a side of the bottom to be below a top of the projecting portion.

3. The liquid container according to either claim 1 or claim 2, the side wall comprising:

a first side wall that is provided with the outlet port; and a second side wall that is arranged to face the first side wall across the projecting portion, an area of the second side wall, including at least part of an opposed area that is opposed to the projecting portion across a space, having optical transparency.

4. The liquid container according to claim 3, the first side wall being continuous with the projecting portion.

5. The liquid container according to claim 3, the first side wall having a clearance from the projecting portion.

6. A liquid ejection apparatus, comprising:

a tank configured to contain a liquid;

a liquid ejection head configured to be communicated with the tank via a supply tube; and a housing provided to place the tank inside thereof, the tank comprising a container portion configured to contain the liquid, an inlet port provided to pour the liquid into the container portion and an outlet port provided to supply the liquid through the supply tube to the liquid ejection head, the container portion comprising a side wall, a bottom and a projecting portion that is provided inside of the container portion to be protruded vertically upward from the bottom, at least part of the side wall forming a visual recognition portion that overlaps a window of the housing, and a first portion of the bottom forming a first liquid reservoir that is visible from the visual recognition portion.

7. The liquid ejection apparatus according to claim 6, a second portion of the bottom forming a second liquid reservoir that communicates with the outlet port, and the first liquid reservoir and the second liquid reservoir being communicated with each other via a communication path that is provided inside of the container portion to be located vertically below a top of the projecting portion.

8. The liquid ejection apparatus according to claim 6, wherein the housing being provided to place the liquid ejection head inside thereof.

9. A liquid ejection apparatus, comprising:

a tank configured to contain a liquid;

a liquid ejection head configured to be communicated with the tank via a supply tube; and a housing that is provided to place the tank inside thereof, the tank comprising a container portion configured to contain the liquid, an inlet port provided to pour the liquid into the container portion and an outlet port provided to supply the liquid through the supply tube to the liquid ejection head, the container portion comprising a side wall, a bottom and a projecting portion that is provided inside of the container portion to be protruded vertically upward from the bottom, the outlet port being located on opposite side of at least one of a visual recognition portion having optical transparency of the side wall and the inlet port, and at least part of the bottom forming a liquid reservoir that communicates with the outlet port.

10. The liquid ejection apparatus according to claim 9, a plurality of the tanks being arranged in a first direction, the outlet port being located on opposite side of at least one of the visual recognition portion and the inlet port in a second direction that is perpendicular to the first direction.

11. The liquid ejection apparatus according to claim 10, a wall of the container portion opposed to the first direction being wider than a wall of the container portion opposed to the second direction.

12. The liquid ejection apparatus according to claim 9, the outlet port and the visual recognition portion being located opposite each other.

13. The liquid ejection apparatus according to claim 12, the inlet port being located closer to the visual recognition portion than the outlet port.

14. The liquid ejection apparatus according to claim 13, the visual recognition portion being formed such that the inside of the tank is recognizable from an outside through a window of the housing, and the window being configured to be openable and closable relative to the tank such that the window is openable when pouring the liquid in the inlet port.

15. The liquid ejection apparatus according to claim 14, an operation panel to operate the liquid ejection apparatus being provided on a surface of the housing where the window is provided.

16. The liquid ejection apparatus according to claim 12, the visual recognition portion having an index indicating an upper limit of the liquid contained inside, one end of the outlet port being provided closer to the bottom than a top of the projecting portion, and another end of the outlet port connecting to the supply tube at a height closer to a height of the index than a height of the top of the projecting portion.

17. The liquid ejection apparatus according to claim 9, the outlet port and the inlet port being located opposite each other.

18. A liquid ejection apparatus, comprising:

a tank configured to contain a liquid; and a liquid ejection head configured to be communicated with the tank via a supply tube, the tank including a container portion configured to contain the liquid, an inlet port configured to pour the liquid into a first area of the container portion, and an outlet port configured to supply the liquid from a second area of the container portion to the supply tube, the second area being located vertically below the first area, a sectional area of the second area when the container portion is cut in a horizontal direction being smaller than a sectional area of the first area when the container portion is cut in the horizontal direction, a first side wall closest to the outlet port being positioned opposite to at least one of a second side wall on which a visual recognition portion is formed and a third side wall closest to the inlet port, the visual recognition portion having optical transparency.

19. The liquid ejection apparatus according to claim 18, wherein the tank including a plurality of tanks arranged in a first direction, and the first side wall is positioned opposite to the at least one of the second side wall and the third side wall in a second direction that is perpendicular to the first direction.

20. The liquid ejection apparatus according to claim 19, wherein a wall facing in the first direction of the container portion is wider than a wall facing in the second direction of the container portion.

21. The liquid ejection apparatus according to claim 18, wherein the first side wall and the second side wall are positioned opposite to each other.

22. The liquid ejection apparatus according to claim 21, wherein the inlet port is closer to the visual recognition portion than the outlet port.

23. The liquid ejection apparatus according to claim 22, wherein the visual recognition portion is arranged such that an inside of the tank is visible through a window of a housing from outside, and the window is openable and closable relative to the tank such that the window is opened while the liquid is poured into the inlet port.

24. The liquid ejection apparatus according to claim 23, further comprises an operation panel disposed on a surface of the housing and configured to operate the liquid ejection apparatus, the window being disposed on the surface of the housing.

25. The liquid ejection apparatus according to claim 18, wherein the first side wall and the third side wall are positioned opposite to each other.

26. The liquid ejection apparatus according to claim 18, wherein the visual recognition portion includes an indicator that indicates an upper limit amount of the liquid to be contained inside, one end of the outlet port is disposed in the second area, and the other end of the outlet port is configured to connect the supply tube at a height that is closer to a height of the indicator than a height of a lower end of the first area.

* * * * *